US006541096B1

(12) United States Patent
Richards et al.

(10) Patent No.: US 6,541,096 B1
(45) Date of Patent: Apr. 1, 2003

(54) POCKETED TOWEL

(75) Inventors: Jeniece M. Richards, 2151 Tona Cir., Las Vegas, NV (US) 89109; Clinton H. Richards, 2151 Tona Cir., Las Vegas, NV (US) 89109

(73) Assignees: Jeniece M. Richards, Las Vegas, NV (US); Clinton H. Richards, Las Vegas, NV (US)

( * ) Notice: Subject to any disclaimer, the term of this patent is extended or adjusted under 35 U.S.C. 154(b) by 0 days.

(21) Appl. No.: 09/927,739

(22) Filed: Aug. 10, 2001

Related U.S. Application Data

(63) Continuation of application No. 09/415,428, filed on Oct. 8, 1999, now abandoned.

(51) Int. Cl.[7] ..... A47G 9/06

(52) U.S. Cl. ..... 428/99; 428/102; 428/126; 297/188.01; 297/229

(58) Field of Search ..... 428/99, 102, 126; 5/417; 297/188.01, 188.12, 228.12, 229

(56) References Cited

U.S. PATENT DOCUMENTS 4,553,785 A 11/1985 Duke, Jr. et al. ..... 297/229
4,793,012 A 12/1988 LaPorte ..... 5/420
4,892,353 A * 1/1990 Goddard ..... 297/234
5,406,659 A 4/1995 Camp ..... 5/417
5,737,785 A * 4/1998 Casey ..... 5/417
5,843,556 A 12/1998 Levas ..... 428/99
6,260,219 B1 * 7/2001 Bartosik ..... 5/417

* cited by examiner

*Primary Examiner*—Alexander S. Thomas

(57) ABSTRACT

A towel made from a single sheet of material has a first set of pockets disposed at corners of the towel that are formed from folds so that the pockets are formed from multiple layers of the material. A second and third set of pockets are disposed between the first set of pockets on a first side and second side, respectively. At least one securing pocket is disposed on the bottom surface of the towel. The towel may be made from a single sheet of material by folding the top edge and bottom edge toward a middle line to form a first and second securing pocket; stitching the first and second securing pockets along the top edge and bottom edge, respectively, to form openings in the securing pockets; folding a first side and second side toward the centerline and sewing lines perpendicular to the centerline to form the pockets.

25 Claims, 9 Drawing Sheets

POCKETED TOWEL

RELATED U.S. APPLICATION DATA

This application is a continuation of U.S. patent application Ser. No. 09/415,428 filed on Oct. 8, 1999 abandoned.

FIELD OF THE INVENTION

The present invention relates to a towel. In particular, the present invention relates to a pocketed towel made from a single sheet of material.

BACKGROUND OF THE INVENTION

Towels are a fixture not only at the beach, but also around the pool and other outdoor gathering places such as parks and picnic areas. The towel's expansive surface provides an excellent barrier between a user and less-than-desirable ground, beach, chaise lounge surfaces, or any other type of surface. A towel's absorbent quality is not only pleasing to the touch, but also functional in absorbing perspiration and dripping water. However, its instability when laid on the ground, beach, or a recliner can result in an uncomfortable surface as it shifts and crumples under and around the user. Winds and breezes worsen the situation by causing the towel to curl from its edges and corners, often landing onto the user with other substances such as dirt. Furthermore, towels are prone to blow off unoccupied recliners, picking up some of the dirt and other substances the user had intended to avoid.

Prior art towels that try to address the instability of towels when used on reclining surfaces, such as a lounge chair have several disadvantages. First, such towels are costly to make since such towels, especially pocketed towels, are normally made from several pieces of material and hence require extra and additional supplies, such as thread or other types of materials, to complete. Second, due to the use of several pieces of material, the prior art towels require additional steps of measuring, aligning, and assembling the towels. Lastly, much time is expended due to the additional steps required to assemble and complete the towel. Thus, such towels today are expensive, difficult, and timely to assemble due to the complexity of making the pocketed towel.

Furthermore, few prior art references deal with the instability of a towel laid on a ground surface. Winds and breezes can cause the towel to curl from its edges and corners thereby covering the user with the towel and other substances such as dirt. Thus, there is a need for a towel that is able to maintain its position on a ground surface.

Lastly, pocketed towels today do not satisfactorily address a user's desire to store a multitude of personal items (such as suntan lotions, paperback books, personal radios and tape decks, pagers, cell phones, keys, wallet, and eyeglasses) within easy reach all the while maintaining stability on reclining or ground surfaces.

Thus, there is a need for a towel that can be made inexpensively using one sheet of material and is not complicated to assemble. Furthermore, there is a need for a towel that is able to maintain its position whether positioned on a reclining surface or on a ground surface. Lastly, there is a need for a pocketed towel that allows for the easy storage and access to items needed or used by a user.

BRIEF DESCRIPTION OF THE INVENTION

A towel made from a single sheet of material has a first set of pockets disposed at corners of the towel that are formed from folds so that the pockets are formed from multiple layers of the material. A second and third set of pockets are disposed between the first set of pockets on a first side and second side, respectively. At least one securing pocket is disposed on the bottom surface of the towel.

A towel is made from a single sheet of material by folding the top edge and bottom edge toward a middle line to form a first and second securing pocket; stitching the first and second securing pockets along the top edge and bottom edge, respectively, to form openings in the securing pockets; folding a first side and second side toward the centerline and sewing lines perpendicular to the centerline to form pockets in the towel.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

In the drawings.

DETAILED DESCRIPTION

Embodiments of the present invention are described herein in the context of a pocketed towel. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The drawings included describe various embodiments of the invention but are not intended to be limiting. Embodiments of the invention are constructed from a rectangular piece of terry cloth, although other fabrics may be employed. A variety of desirable colors and combinations are also possible.

Figure 1:
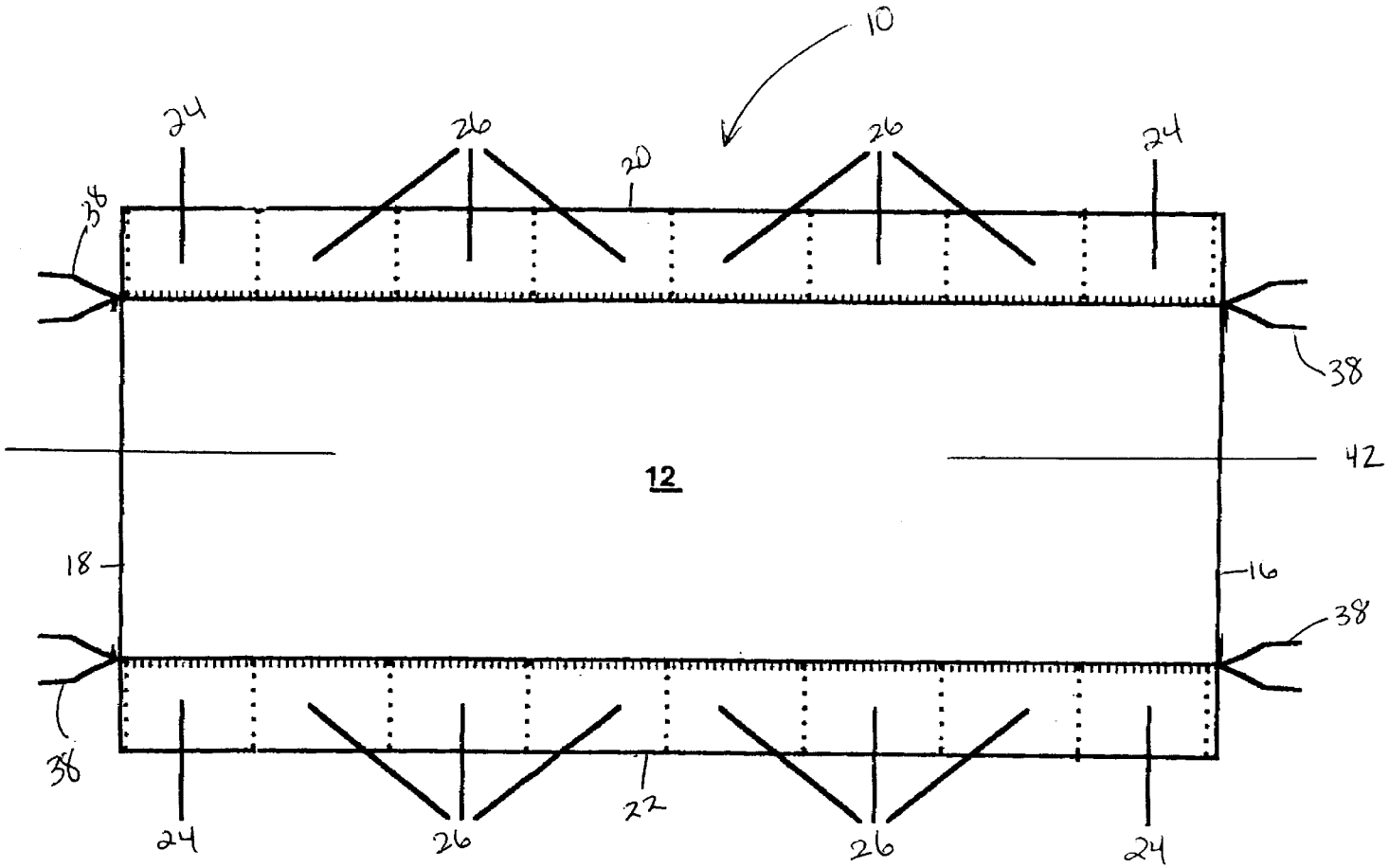
FIG. 1 is a front view of an embodiment of the present invention.
Figure 2:
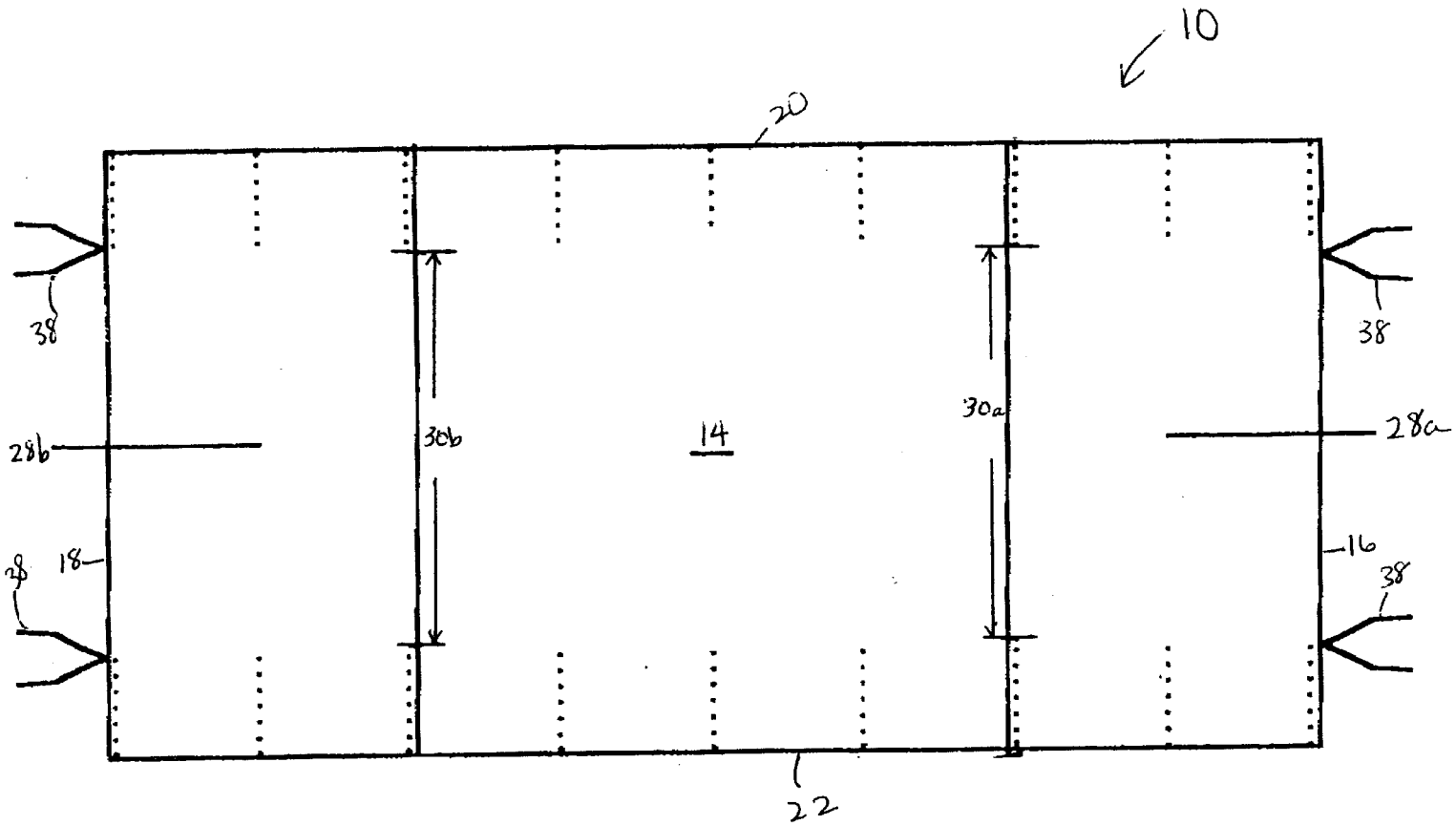
FIG. 2 is a back view of the embodiment shown in FIG. 1.

As shown in FIGS. 1 and 2, a towel 10, made from a single sheet of material, has a top surface 12, a bottom surface 14, a top edge 16, a bottom edge 18, a first side 20, and a second side 22. The towel 10 has a first set of pockets 24 disposed at the corners of the towel 10 on the top surface 12. The first set of pockets 24 are formed from folds of the towel 10 so that each pocket 24 is formed from multiple layers of the material. The multiple layers provide the extra weight necessary to keep the towel stabilized when in use either on a chair such as a lounge chair, a flat surface such as the beach, or in any other position. Thus, the towel is inhibited from curling at the corners or blowing off from the chair or ground.

The towel 10 also has a second set of pockets 26 disposed between the first set of pockets 24 on the top surface 12 at the first side 20 and the second side 22. The second set of pockets 26 allow the user to store personal items such as suntan lotions, books, radios, compact disk players, pagers, phones, keys, wallets, or any other personal items, all within easy reach. Although there are 12 total pockets 26 shown in the drawing, the number of pockets is not intended to be limiting since the towel may be made with any convenient number of pockets.

Figure 3:
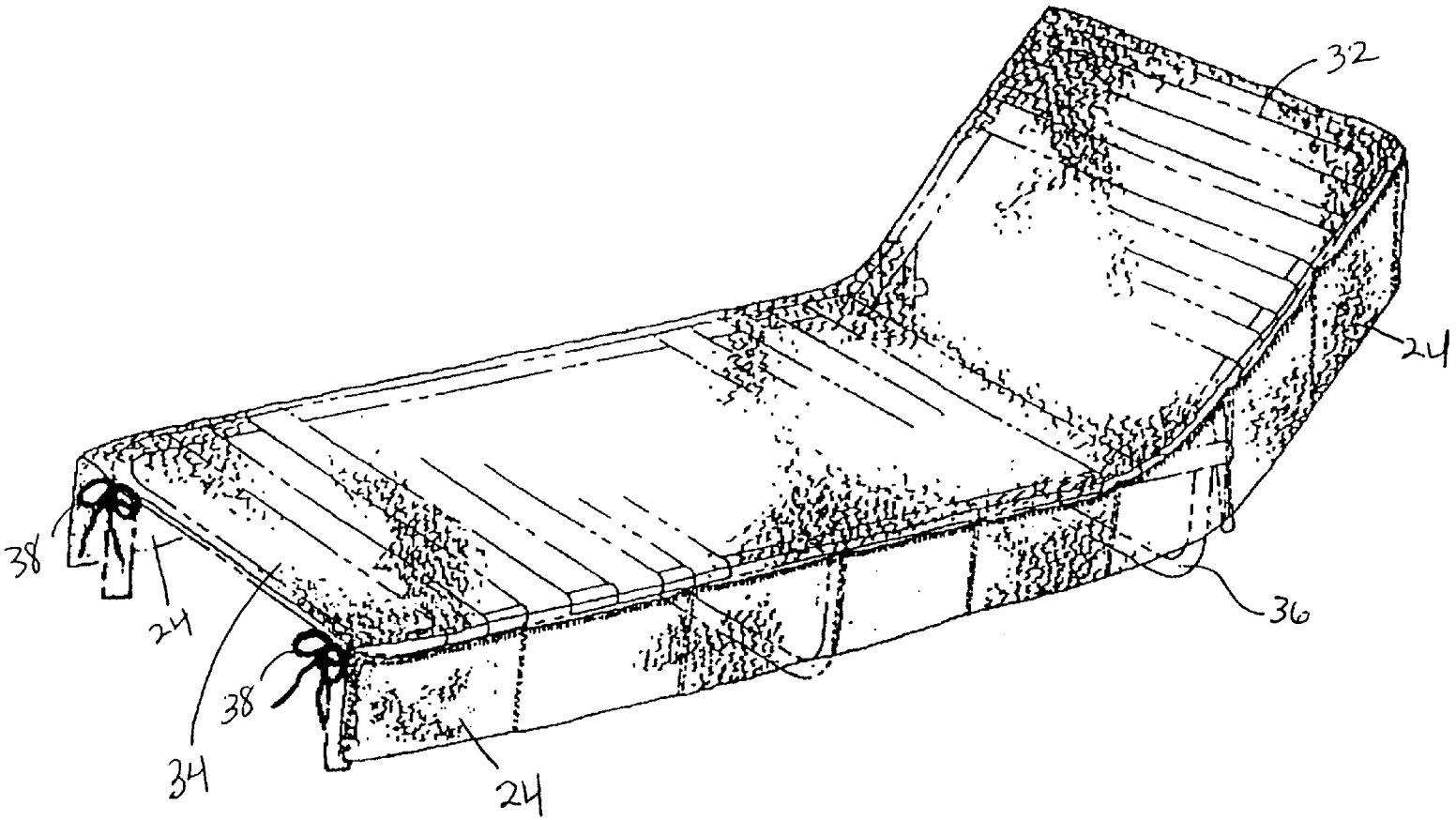
FIG. 3 is a view of an embodiment of a pocketed towel in accordance with the present invention in use on a lounge chair.

As shown in FIG. 2, the towel 10 has two securing pockets 28*a* and 28*b* on the bottom surface 14. The first securing pocket 28*a* is at the top edge 16, and the second securing pocket 28*b* is at the bottom edge 18. The securing pockets 28*a* and 28*b* are to secure the towel to a chair. As shown in FIG. 3, the towel 10 is used to cover a lounge chair 36. Securing pocket 28*a* may be used to cover the top portion 32 of the chair 36 while securing pocket 28*b* may be used to cover the bottom portion 34 of the chair 36. Thus, the openings 30*a* and 30*b* are preferably at least the size of a width of a chair. Those of ordinary skill in the art will realize that there are different types of chairs that may be used such as a lounge chair, beach chair, or perhaps the towel may be used on a cushion. Thus, the openings 30*a* and 30*b* may be sized to any width necessary and is not intended to be limiting. Furthermore, although it is preferable to have two securing pockets, the number of securing pockets is not intended to be limiting since the towel may be made with one or more securing pockets.

Figure 4:
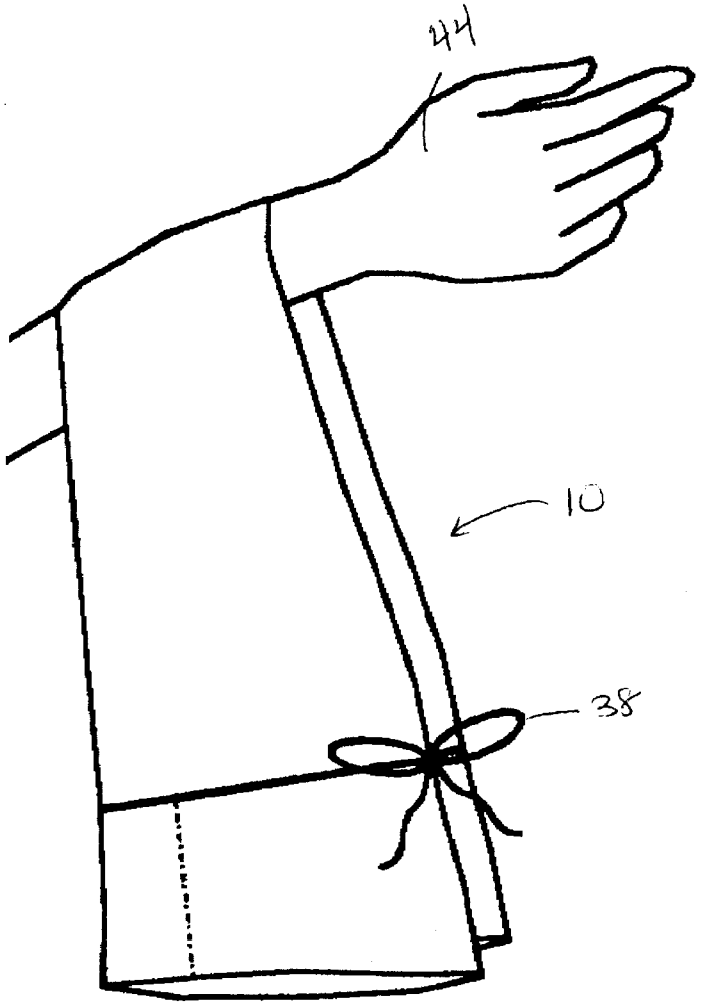
FIG. 4 is a view of an embodiment of a pocketed towel in accordance with the present invention in use draped over an arm for carrying.

The towel 10 also may have ties 38 disposed on the top edge 16 and the bottom edge 18. The ties 38 provide additional stability when the towel 10 is used on a chair 36 as shown in FIG. 3. The ties 38 may be tied to the chair 36 to prevent the towel from slipping or blowing away. The ties 28 also allow for ease of folding and carrying the towel 10 as shown in FIG. 4. The towel 10 may be rolled up, tied with the ties 38 and draped over an arm 44 for ease of carrying the towel 10. In another alternative, the towel may also be draped over a shoulder (not shown). Although ties are used in the preferred embodiment, those of ordinary skill in the art will realize that other means of tying the towel to a chair is possible, such as the use of a hook and loop fastener.

Figure 5:
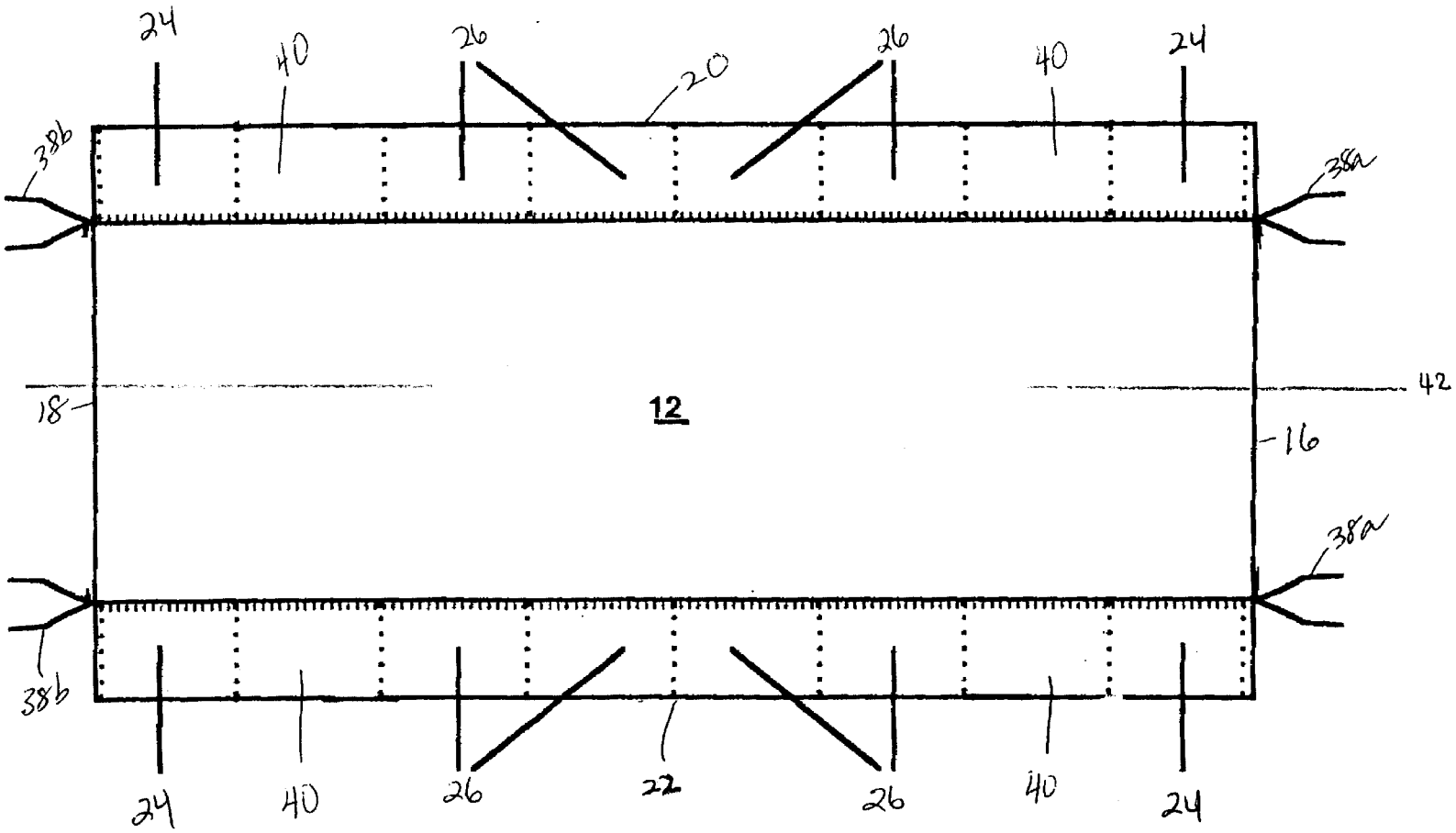
FIG. 5 is a front view of yet another embodiment of the present invention.

In a second embodiment, as shown in FIG. 5, the towel 10 has a third set of pockets 40 disposed adjacent to the first set of pockets 24. The third set of pockets 40 are formed in the same manner as the first set of pockets 24. The third set of pockets 40 are formed from folds so that each pocket 40 is formed from multiple layers of the material. The third set of pockets 40 provide additional weight and thus further provides for additional stabilization to the towel 10.

All of the pockets 24, 26, and 40 have openings facing the centerline 42 of the towel 10. The openings may be secured with any means known in the art such as hook and loop fasteners, buttons, snaps, and the like.

As best shown in FIGS. 6 through 8, the towel is formed from only one single sheet of material thereby making it easier to assemble and less expensive to make. No additional assembly or material is required and thus, the additional steps of measuring, aligning, and assembling the towel is eliminated as well as the time to make the towel. It is preferable that the material be an absorbing fabric such as terry cloth, however, any type of material may be used.

Figure 6B:
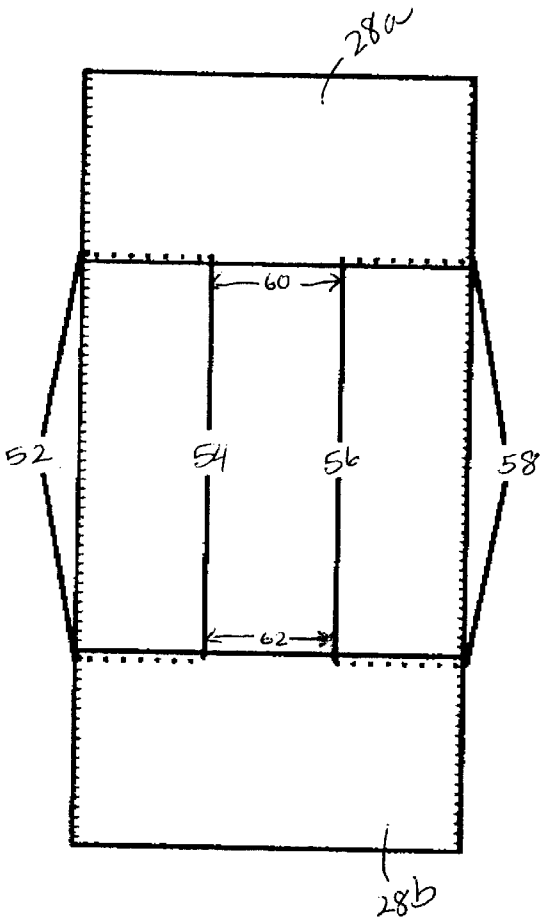
FIGS. 6A and 6B illustrate the assembly of the back surface of an embodiment of the present invention.
Figure 6A:
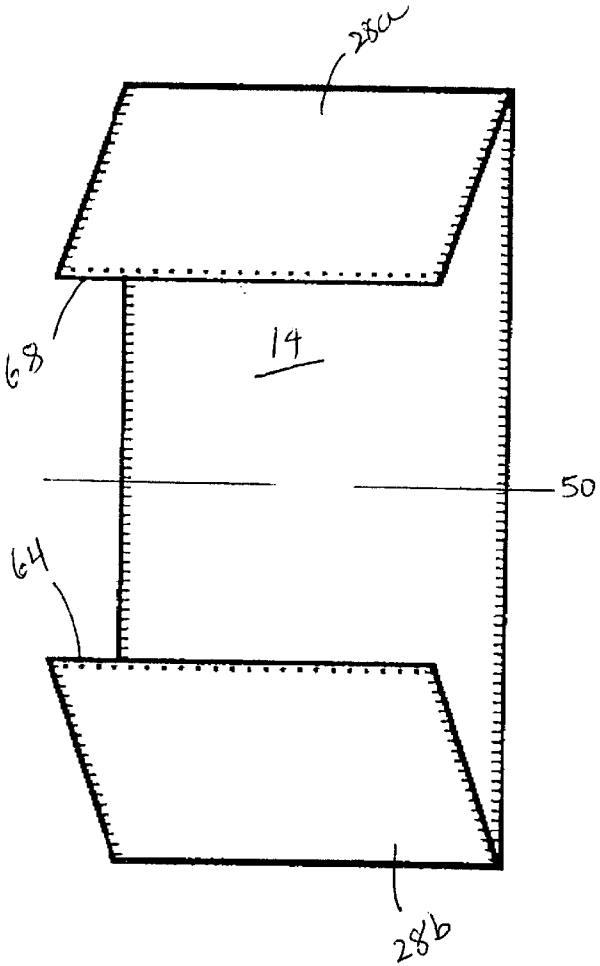

As shown in FIG. 6A, on the bottom surface 14, the top edge 68 and bottom edge 64 are folded toward a middle line 50. This forms the securing pockets 28*a* and 28*b* on the bottom surface 14. The length of the securing pockets 28*a* and 28*b* may vary according to its use. In the embodiment shown, the securing pockets 28*a* and 28*b* are long enough to fit over the top 32 and bottom 34 portions of a lounge chair. As shown in FIG. 6B, the securing pockets 28*a* and 28*b* are stitched from 52 to 54 and from 56 to 58. Openings 60 and 62 are preferably the size of the width of a chair so that securing pockets 28*a* and 28*b* may be fitted onto the top 32 and bottom 34 portions of a chair 36.

Figure 7B:
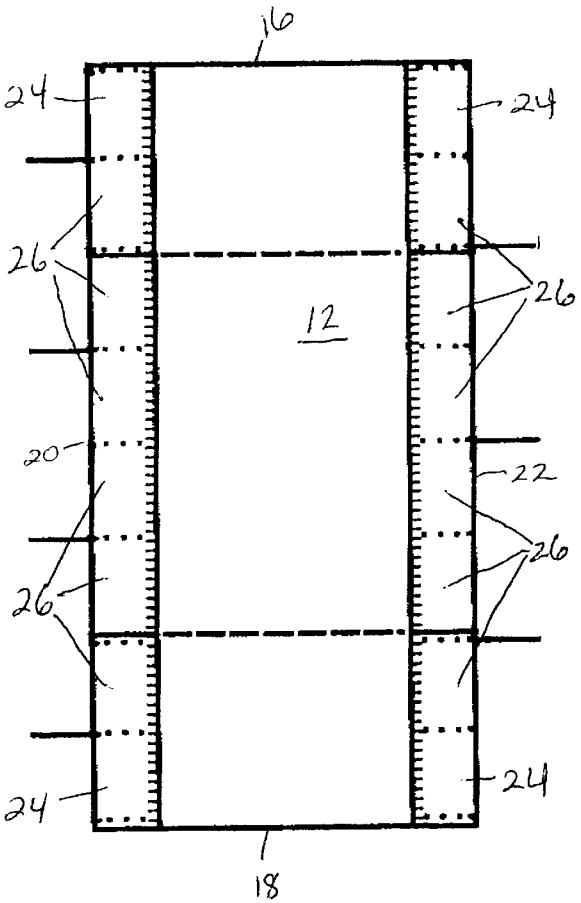
FIGS. 7A and 7B illustrate the assembly of the front surface of an embodiment of the present invention.
Figure 7A:
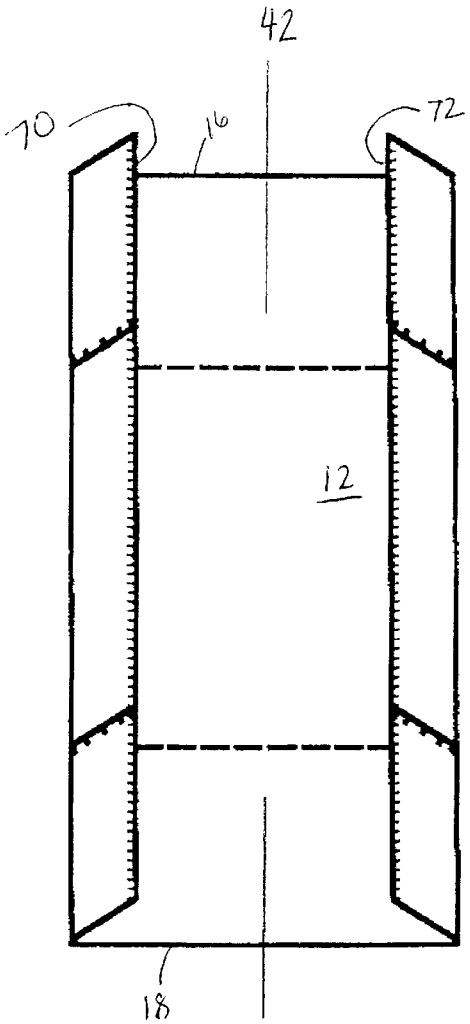

Now referring to FIG. 7A, first side 70 and second side 72 on the top surface 12 are folded toward the centerline 42. The length of the fold should be enough to securely contain personal items such as a cell phone, suntan lotion, and the like. As shown in FIG. 7B, several lines 74 are stitched perpendicular to the centerline at select locations. This forms the pockets 34 and 26 of the towel 10. The number of and width size of the pockets may vary according to the needs of a user and thus, the number of lines 74 stitched is not intended to be limiting in any way. Furthermore, the fold on one side of the pockets provides reduced labor costs, and increased pocket strength and durability.

Through these series of folds and stitches, the first set of pockets 24 (and the third set of pockets 40 as shown and described in the second embodiment in FIG. 5) is formed from four layers of the material. This provides the additional weight and stabilization necessary to prevent the towel from shifting or moving. Thus, the towel is not likely to curl in breezy conditions even when no weighted items are in the corner or side pockets.

Figure 8A:
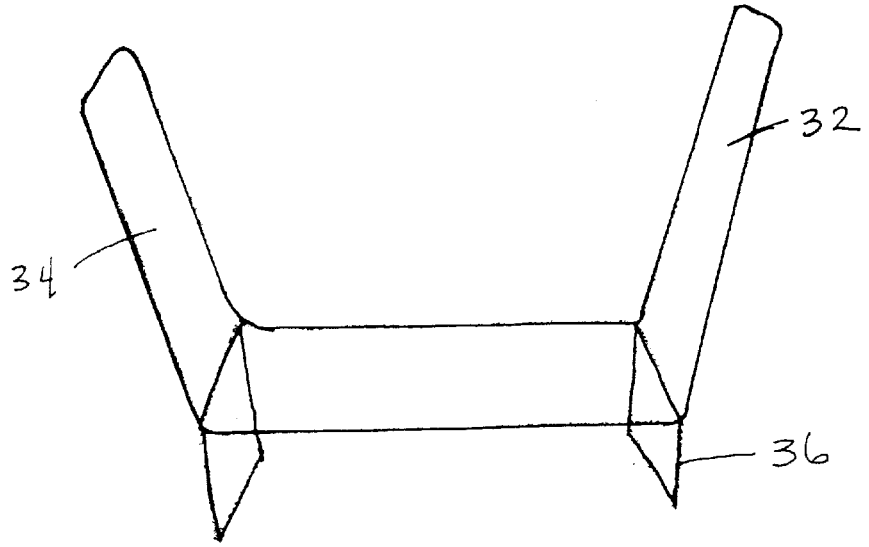
FIGS. 8A and 8B illustrate the use of a towel in accordance with the present invention on a lounge chair.
Figure 8B:
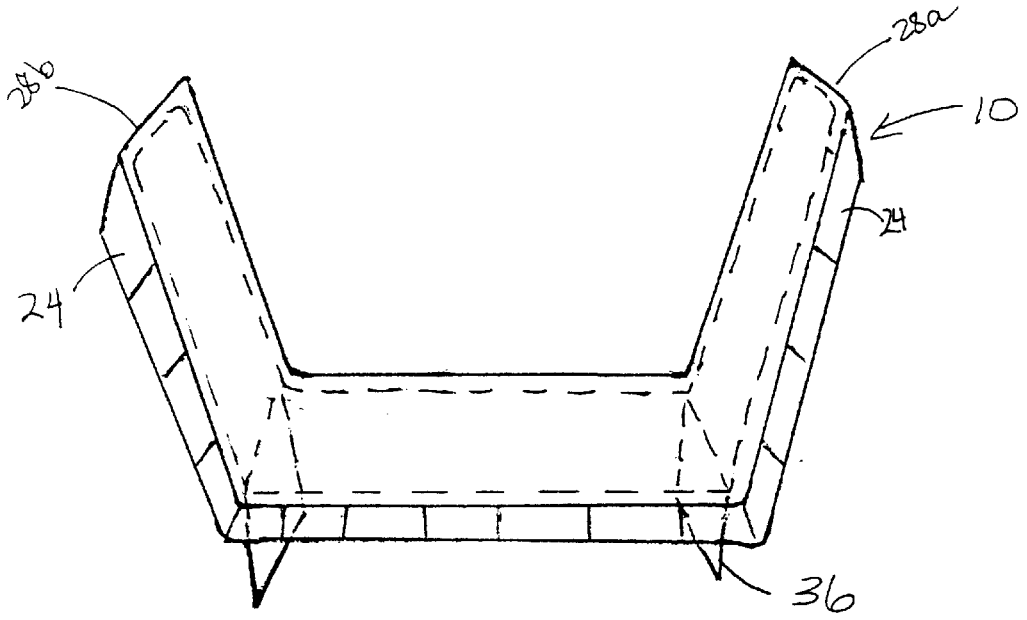

In use on a chair 36, such as a lounge chair, the chair 36 is folded into a first position, as shown in FIG. 8A so that the towel 10 may be placed onto the chair 36. The top portion 32 and bottom portion 34 are raised. As shown in FIG. 8B, the securing pockets 28*a* and 28*b* are draped over the chair 36. The chair 36 is then repositioned into a useable position, as shown in FIG. 3. The pockets are then hung from the sides of the chair 36 whereby the first set of pockets 24 stabilize the towel 10 when it is not in use or otherwise secured to the chair 36. Ties 38 may also be used to provide additional stabilization of the towel 10 to the chair 36.

Figure 9:
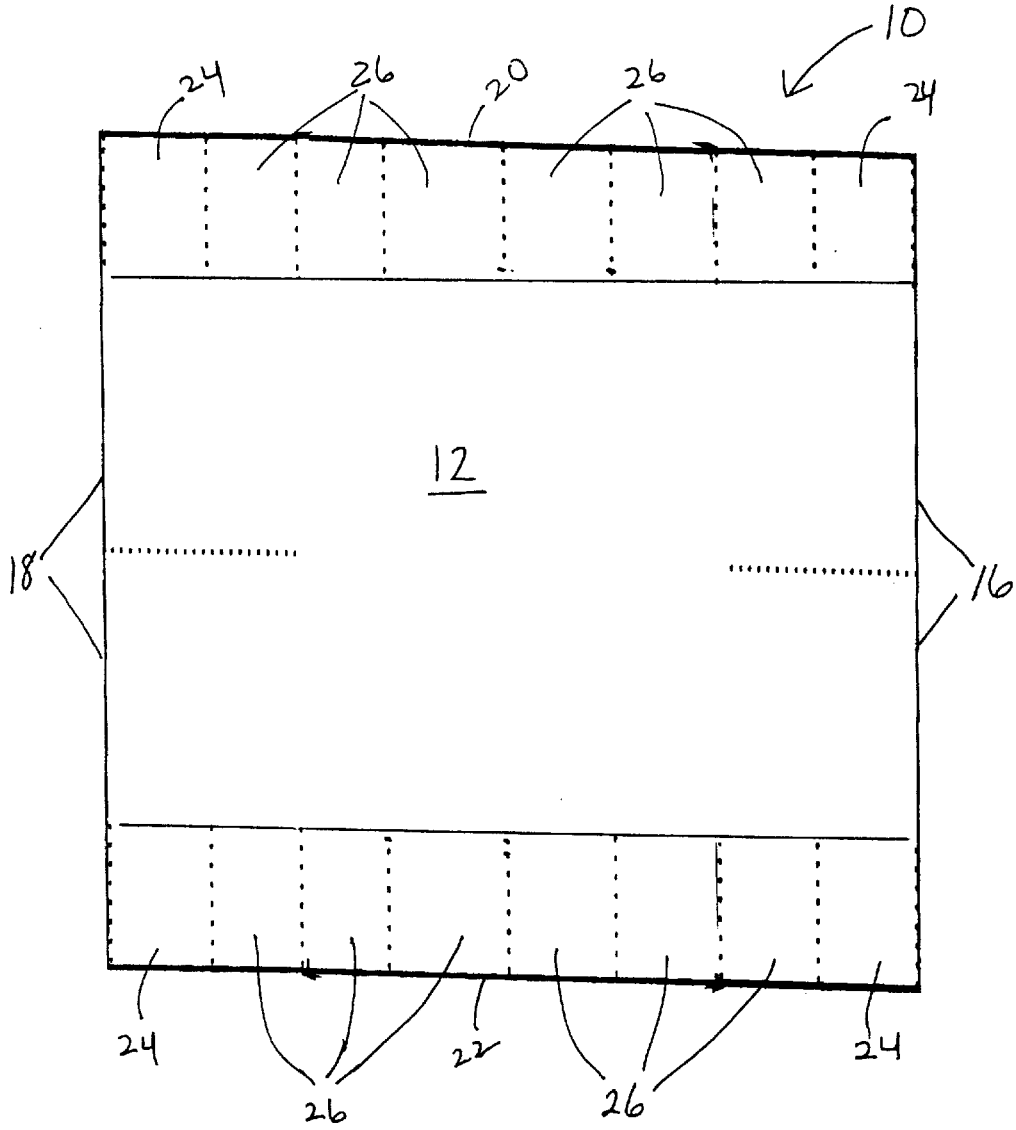
FIG. 9 is a front view of yet another embodiment of the present invention.

While embodiments and applications of this invention have been shown and described, it would be apparent to those skilled in the art having the benefit of this disclosure that many more modifications than mentioned above are possible without departing from the inventive concepts herein. For example, the towel may be made form a single sheet of material for a two-person use, as shown in FIG. 9. The invention, therefore, is not to be restricted except in the spirit of the appended claims.

What is claimed is:

1. A towel made from a single sheet of material, comprising:

a top surface, a bottom surface, a top edge, a bottom edge, a first side, a second side, and a centerline disposed between said first side and second side, said first side parallel to said second side and said top edge parallel to said bottom edge;

a first plurality of pockets disposed at corners of said top surface, wherein said first plurality of pockets are formed from folds so that each of said first plurality of pockets is formed from four layers of the material;

a second plurality of pockets disposed on said top surface of the towel at said first side wherein each of said second plurality of pockets is disposed substantially between a pair of said first plurality of pockets disposed on said first side;

a third plurality of pockets disposed on said top surface of the towel at said second side wherein each of said third plurality of pockets is disposed substantially between a pair of said first plurality of pockets disposed on said second side; and at least one securing pocket disposed on said bottom surface at said top edge, wherein each of said first plurality of pockets, said second plurality of pockets, and said third plurality of pockets have an opening facing said centerline.

2. The towel of claim 1 wherein said securing pocket has an opening width at least the size of a width of a chair.

3. The towel of claim 1 further comprising a second securing pocket at said bottom edge of said bottom surface.

4. The towel of claim 3 wherein said first securing pocket and said second securing pocket have an opening width at least the size of a width of a chair.

5. The towel of claim 1 further comprising a fourth plurality of pockets disposed adjacent to said first plurality of pockets, wherein said fourth plurality of pockets are formed from folds so that each of said fourth plurality of pockets is formed from four layers of the material.

6. The towel of claim 5 wherein said second plurality of pockets are disposed substantially between a pair of said fourth plurality of pockets at said first side.

7. The towel of claim 5 wherein said third plurality of pockets are disposed substantially between a pair of said fourth plurality of pockets at said second side.

8. The towel of claim 1 wherein the material is an absorbing fabric.

9. The towel of claim 1 wherein the material is a terry cloth fabric.

10. The towel of claim 1 further comprising a plurality of ties on said top edge and said bottom edge.

11. The towel of claim 1 wherein said openings further comprise a means to secure said openings.

12. A towel made from a single sheet of material, comprising:

a top surface, a bottom surface, a top edge, a bottom edge, a first side, a second side, and a centerline disposed between said first side and said second side, said first side parallel to said second side and said top edge parallel to said bottom edge;

a first plurality of pockets disposed at corners of said top surface, wherein said first plurality of pockets are formed from folds so that each of said first plurality of pockets is formed from four layers of the material; and at least one securing pocket disposed on said bottom surface at said top edge, wherein each of said first plurality of pockets has an opening facing said centerline.

13. The towel of claim 12 further comprising a second plurality of pockets disposed on said top surface of the towel at said first side wherein each of said second plurality of pockets is disposed substantially between a pair of said first plurality of pockets disposed on said first side.

14. The towel of claim 12 further comprising a third plurality of pockets disposed on said top surface of the towel at said second side wherein each of said third plurality of pockets is disposed substantially between a pair of said first plurality of pockets disposed on said second side.

15. The towel of claim 12 wherein said securing pocket has an opening width at least the size of a width of a chair.

16. The towel of claim 12 further comprising a second securing pocket at said bottom edge of said bottom surface.

17. The towel of claim 16 wherein said first securing pocket and said second securing pocket have an opening width at least the size of a width of a chair.

18. The towel of claim 12 further comprising a fourth plurality of pockets disposed adjacent to said first plurality of pockets, wherein said fourth plurality of pockets are formed from folds so that each of said fourth plurality of pockets is formed from four layers of the material.

19. The towel of claim 18 wherein said second plurality of pockets are disposed substantially between a pair of said fourth plurality of pockets at said first side.

20. The towel of claim 18 wherein said third plurality of pockets are disposed substantially between a pair of said fourth plurality of pockets at said second side.

21. The towel of claim 18 wherein said second plurality of pockets, said third plurality of pockets, and said fourth plurality of pockets have an opening facing said centerline.

22. The towel of claim 21 wherein said openings further comprise a means to secure said openings.

23. The towel of claim 12 wherein the material is an absorbing fabric.

24. The towel of claim 12 wherein the material is a terry cloth fabric.

25. The towel of claim 12 further comprising a plurality of ties on said top edge and said bottom edge.

* * * * *